US005865687A

United States Patent [19]

Alzano

[11] Patent Number: 5,865,687

[45] Date of Patent: Feb. 2, 1999

[54] MODULATOR SYSTEM FOR GOLF CLUBS

[76] Inventor: Brian Alzano, Long Barrow, Haytown, Bulkworthy, Holsworthy, Devon, United Kingdom, EX22 7UW

[21] Appl. No.: 719,885

[22] Filed: Sep. 25, 1996

[30] Foreign Application Priority Data

Sep. 26, 1995 [GB] United Kingdom ..... 9519573

[51] Int. Cl.[6] ..... A63B 53/06

[52] U.S. Cl. ..... 473/313; 473/336; 473/341; 473/345; 473/332

[58] Field of Search ..... 473/295, 297, 473/334, 336, 340, 341, 313, 314, 244, 246, 247, 248, 332, 345

[56] References Cited

U.S. PATENT DOCUMENTS

| | | | |
|---|---|---|---|
| 1,906,239 | 5/1933 | Reach | 473/310 |
| 2,051,083 | 8/1936 | Hart | 473/297 |
| 3,042,405 | 7/1962 | Solheim | 473/313 |
| 3,206,206 | 9/1965 | Santosuosso | 473/248 |
| 3,595,582 | 7/1971 | Chapman | 473/244 |
| 3,909,005 | 9/1975 | Piszel . | |
| 4,506,888 | 3/1985 | Nardozzi | 473/313 |
| 5,090,698 | 2/1992 | Kleinfelter . | |
| 5,292,123 | 3/1994 | Schmidt | 473/248 |
| 5,346,219 | 9/1994 | Pehoski | 473/340 |
| 5,377,980 | 1/1995 | Hannon | 473/248 |
| 5,509,660 | 4/1996 | Elmer | 473/330 |
| 5,511,779 | 4/1996 | Meyers | 473/246 |
| 5,571,053 | 11/1996 | Lane | 473/340 |

FOREIGN PATENT DOCUMENTS 2278063 11/1994 United Kingdom .

*Primary Examiner*—Sebastiano Passaniti
*Assistant Examiner*—Stephen L. Blaw
*Attorney, Agent, or Firm*—Harold L. Novick; Nath & Associates

[57] ABSTRACT

A golf club comprises a head and a shaft, in which the head comprises a strike face and has a toe or distal end and a heel or proximal end and the lower end of the shaft comprises a connection bar which extends longitudinally of the head behind the strike face, the connection bar being attached to the head at the toe end region thereof, the interconnection zone between the shaft and bar being provided with shock-absorption properties, the connection bar acting as a lever when the ball is struck and the shock-absorption properties influencing the strike response characteristics of the club. The interconnection zone may comprises a torsion link including a block or body having a counterbalancing effect to the toe end mounting and which receives the proximal end of the connection bar and the lower end of the shaft. The shaft may include a longitudinally-movable counterbalance weight.

9 Claims, 3 Drawing Sheets

MODULATOR SYSTEM FOR GOLF CLUBS

The present invention relates to golf clubs. More particularly, the invention relates to means for modulating the strike or balancing characteristics of golf clubs.

As the playing aspects of golf courses, individual fairways and putting greens, vary, it would be useful to golfers if they were able to select one of several different clubs or putters to give them the best option for the conditions prevalent in any particular situation. Despite the fact that a set of golf clubs includes a range of types and heads for particular situations, a greater element of choice would still be desirable. This, however, is generally impractical with conventional clubs as they have to be carried about the course and as the number of clubs permitted to be carried is limited by the rules of golf.

It is, therefore, an object of the invention to provide a golf club, particularly a putter, which has a variety of strike characteristics. It is a further object to provide a golf club having sufficient weight for a powerful strike or impact while having properties such that in use the feel is similar to that of a lighter-weight club.

According to a first aspect of the present invention, a golf club comprises a head and a shaft, in which the head comprises a strike face and has a toe or distal end and a heel or proximal end and the lower end of the shaft comprises a connection bar which extends longitudinally of the head behind the strike face, the connection bar being attached to the head at the toe end region thereof, the interconnection zone between the shaft and bar being provided with shock-absorption properties.

The connection bar, which may be solid or hollow, provides a leverage effect when the ball is struck and the shock-absorption properties influence the strike response characteristics of the club.

Preferably, the mounting for the connection bar towards the toe end of the club is longitudinally adjustable, that is, towards and away from the heel end, thereby enabling the balance and strike response characteristics to be adapted for different greens and slopes and to alter the position and area of the "sweet spot". The mounting may comprise a locator element having a predetermined weight, to influence the balance of the club, and may be flexurally mounted to the connector bar to influence the "feel" of the club when hitting the ball. The mounting may be weight-adjustable. The balance and strike response characteristics may additionally be influenced by internal profiling of the head itself, so that the weight distribution of the head can be altered in relation to the main striking area of the face. The centre of gravity of the club, which primarily affects the balance thereof, may be moved within the head or even to a notional position outside the head, by manipulation of the weight and mounting variables. With the centre of gravity towards the toe end, a "flat spot" area can be created at the toe end which is suitable for striking the ball on fast greens or downhill slopes, whereas with the centre of gravity towards the heel end of the club is better adapted for slow greens or uphill puts or other situations where more power is required.

Optionally, the bar may include an axially-adjustable weight as a further way of altering the balance of the club. The adjustment may be effected externally of the head, for example by providing the bar with an external screw thread on which the weight is disposed, having a complementary internal screw thread, the bar being axially rotatable from the outside to alter the position of the weight thereon. The bar may be extended towards the heel end of the head beyond the interconnection zone, to carry the axially-adjustable weight or a further weight which may be axially adjustable.

The interconnection zone may comprise a torsion link between the connection bar and the shaft, to provide the shock-absorption properties. The torsion link may include a block or body the weight of which counterbalances the weight of the distal mounting and therefore influences the leverage effect exerted by the connection bar. The block receives the lower end of the shaft and the proximal end of the connection bar, whereby the block absorbs impact forces on striking the ball. The lower end region of the shaft may be loosely or resiliently connected to the upper part of the club head, thereby providing shock-absorptive, preferably resilient, limited movement between the shaft and head.

The proximal end of the bar and the connection to the shaft is preferably disposed in relation to the club head between the centre and the heel end thereof, to enable optimum balance to be achieved. In order to avoid undue visual obstruction of the club head and the ball, the shaft is preferably at a distance less than 30% of the head length from the heel, the exact location being determined according to the desired balance and strike response. Further to minimise visual obstruction, the shaft may be attached to the connection bar via a cranked link which displaces the axis of the shaft away from the proximal mounting of the connection bar, thereby preventing the shaft from partially obscuring the head. The cranked link may comprise a goose-neck connector which may be rotationally adjustable in the connection bar and which may have a further bend, out of the plane which accommodates the goose-neck, to provide for the lie angle of the club to be adjusted. Alternatively, for adjustment of the lie angle the lower end of the shaft or a link element between the shaft and the connection bar may be pliable or bendable.

Preferably, where a cranked link is used, it may be rotated about its axis through 360° prior to being fixed in the desired position. Thus, both left- and right-handed assembly is provided for. The angle of the cranked link may be selected to give the smoothest and most pleasing appearance to the finished club setting. The angle and length of the intermediate portion govern the degree of displacement between the axes of the end portions.

Preferably, rotation of the link towards the centre of the club head tends to balance the club towards face balancing. Thus, in the position wherein the cranked link is rotated to lie along the centre line of the head, with the displacement towards the toe end of the head, the balanced weight of the club is in the lightest feel position and is balanced equally for both right- and left-handed golfers; the link may be bendable in this position to adjust the lie angle. Rotation through 180° about the same point will bring the club to the heaviest feel position, while rotation to a forwardly-angled position would introduce offset in that the face would be behind the axis of the shaft.

The materials of construction of the dimensions of the constituent parts may be selected according to density, hardness or other property, depending on the desired characteristics of the club in terms of weight, balance and the degree of hardness or softness required in hitting the ball.

Removable weights may be provided at either end of the head, to enable the final characteristics to be determined by the golfer in use, according to the conditions of play.

The first aspect of the invention may be applied either to a traditional flat-faced club or to a club having a cylindrical head. With a cylindrically-headed club, the connection bar and distal mounting may conveniently be located within the head, an end cap constituting a closure member for the cylinder being provided at the toe or distal end thereof. The proximal or heel end may be sealed with another end cap;

the weights of the end caps may be selected to contribute to the overall balance characteristics of the club. Optionally the heel end cap may be attached to a rearward extension of the connection bar and may be undersized in relation to the internal diameter of the head, to provide relative floating movement therebetween which may be damped with a resilient sealing member.

According to a second aspect, the invention provides a golf club, preferably a putter, having a variety of strike characteristics, in which the shaft of the club is provided internally with a movable counterbalance weight operatively connected to external adjustment means whereby, in use, the centre of gravity of the club can be varied by adjusting the position of the counterbalance weight in the shaft.

Although intended primarily for application to putters, the second aspect of the invention is also applicable to other types of clubs, namely irons and woods, and may be fitted as a modification to an existing club. The second aspect of the invention therefore also comprehends a shaft for a golf club, the shaft being connectible at one end to a golf club head and being provided internally with a movable counterbalance weight operatively connected to external adjustment means for adjusting the position of the weight in the shaft in use. The second aspect of the invention enables the neutral balance position to be moved towards the grip portion of the shaft, thereby reducing the apparent weight of the club in use and enabling a smoother dynamic action in a striking or putting stroke than is possible with a conventional club.

Preferably, the counterbalance weight has a value in the range of from 25 g to 500 g. In practice, the value selected depends upon the weight of the head of the club itself and the desired performance characteristics and/or trajectory to be imparted to a ball in use.

Optionally, the upper part of the shaft comprises a further, static, counterbalance weight the effectiveness of which can be adjusted by altering the position of the movable counterbalance weight within the shaft.

The adjustment means may lie next to the grip portion of the shaft but are preferably integral therewith.

Preferably, the shaft counterbalance weight is adjusted by means of a worm driven mechanism carried within the shaft. The worm drive mechanism may comprise a rotatable threaded rod, on which the counterbalance weight is threadedly carried, including means to restrain the weight from rotation within the shaft to effect longitudinal movement of the weight on rotation of the rod. The rod may be formed with or attached to an operating knob which extends from the top of the shaft or is preferably integral with the grip portion of the shaft.

Preferably, means are included to prevent the weight from falling off the end of the threaded rod. Such means may be provided by the internal contouring of the shaft, that is, the shaft may taper inwardly at or towards the lower end region of the rod, a lug may be provided to restrain further downward movement of the weight, or the shaft may be solid below the threaded rod.

The means whereby the weight is restrained from rotation within the shaft may include a peg or shoulder projecting from the weight or a rail projecting from the internal wall of the club shaft, the peg or rail being located in a slot or groove provided in the other of the weight and the internal wall of the shaft, such that the slot guides the movement of the weight along the threaded rod. Preferably, the weight is provided with a peg and the slot or groove is provided in the inner wall of the club shaft. The weight may be provided with a coating of a resilient compound to eliminate rattle within the shaft.

The two aspects of the invention, as defined above, may be applied to the same club so that the counterbalance weight of the second aspect compensates for increases in the mass of the club head attributable to the components of the first aspect.

Embodiments of the invention will now be described by way of example with reference to the accompanying drawings, of which FIG. 1 is an exploded perspective view of the component parts for a cylindrical head for a putter with improved balance properties, according to one embodiment of the first aspect of the present invention.

Figure 1:
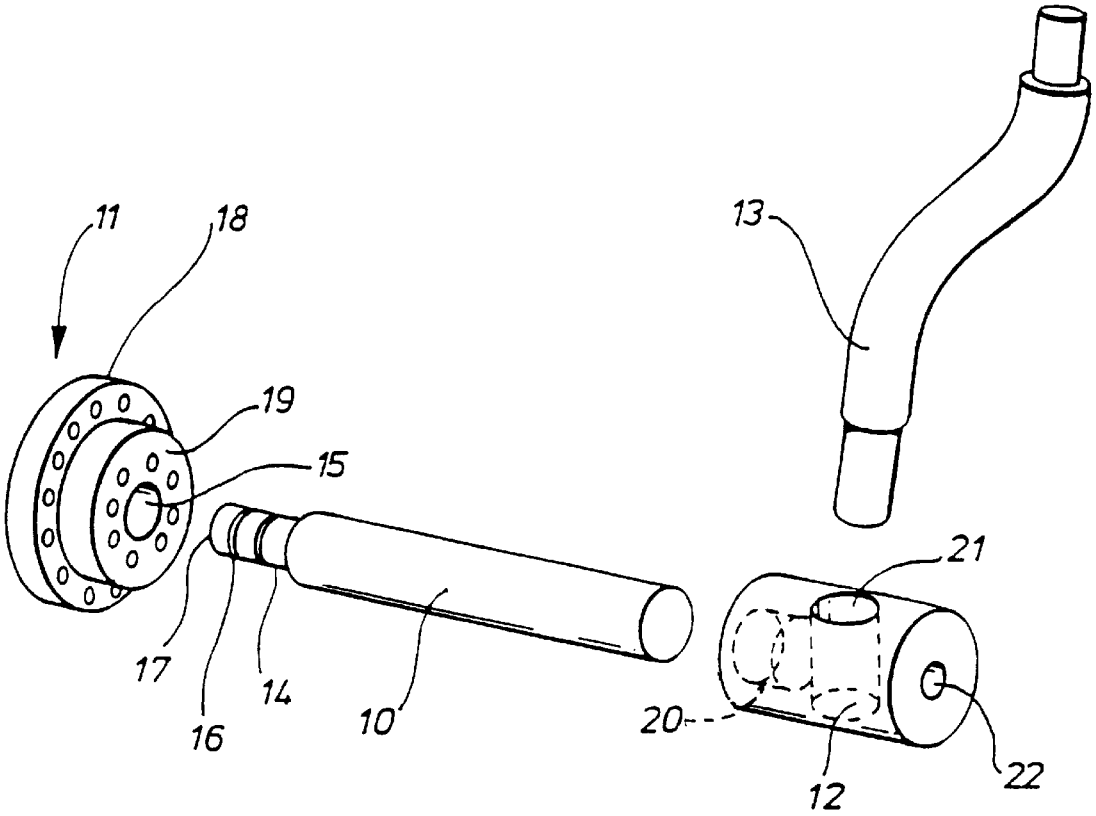

With reference to FIG. 1, the component parts for a cylindrical putter head are shown as a connection bar 10, a locator element or disc 11, a connection block 12 and a goose-neck connector 13. The remote or distal end of the connecting bar 10 is formed as a shank 14 which is inserted and fixed with adhesive in a central hole 15 formed in the locator element 11; the shank 14 may be provided with grooves 16 to increase the bonding area for the adhesive and with an axial hole 17 to facilitate a degree of relative movement between the connecting bar 10 and the locator element. The locator element 11 is formed as an outer annulus 18, the primary purpose of which is to provide weight, and an inner annulus 19 the purpose of which is to facilitate flexure with the connecting bar, thereby to affect the "feel" of the putter. The array of holes formed in the locator element is for weight-adjustment purposes.

The connection block or body 12 is formed with a central aperture 20 to receive the proximal end of the connection bar 10, a radially-disposed hole 21 for receiving the goose-neck connector, and a smaller central hole 22 to receive a locking pin (not shown) for the goose-neck connector.

Figure 2:
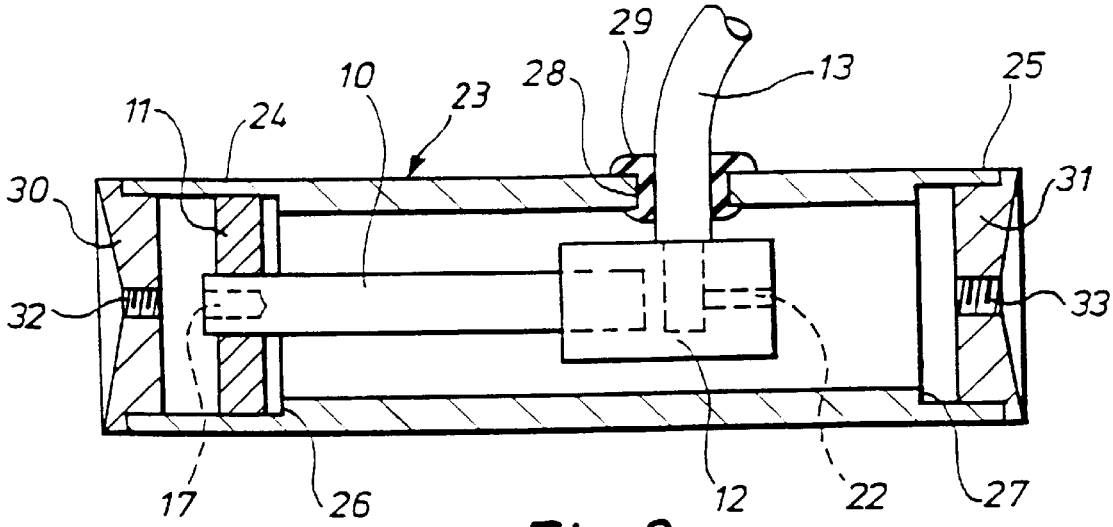
FIG. 2 is a longitudinal sectional view of a putter head containing components similar to those shown in FIG. 1.

With reference to FIG. 2, similar component parts to those shown in FIG. 1 are contained within a cylindrical putter head 23. The head is provided with end regions 24, 25 of enlarged internal diameter terminating with shoulders 26, 27. The upper part of the head 23 is formed with an aperture 28 to accommodate the goose-neck connector; a resilient grommet 29 seals the hole and provides some resilient flexure for the connector.

The assembled head shown in FIG. 2 has a locator element 11 without separate annuli and the connecting bar 10 does not have a shank 14 of reduced diameter. The locator element may be axially positioned at any desired location between the toe end cap 30 and shoulder 26, according to the desired weight distribution characteristics of the putter; similarly, the toe or distal end cap 30 and heel or proximal end cap 31 may be selected in size to extend inwardly towards respective shoulders 26, 27. The end caps or closures are provided with central tapped holes 32, 33 for addition of further weights, as desired. It will be appreciated that the inner wall of the cylindrical head 23 between the shoulders 26, 27 may be profiled by, for example, the provision of annular grooves or by forming it as a frusto-conical or tapered shape, also in order to influence the weight distribution characteristics.

Figure 3:
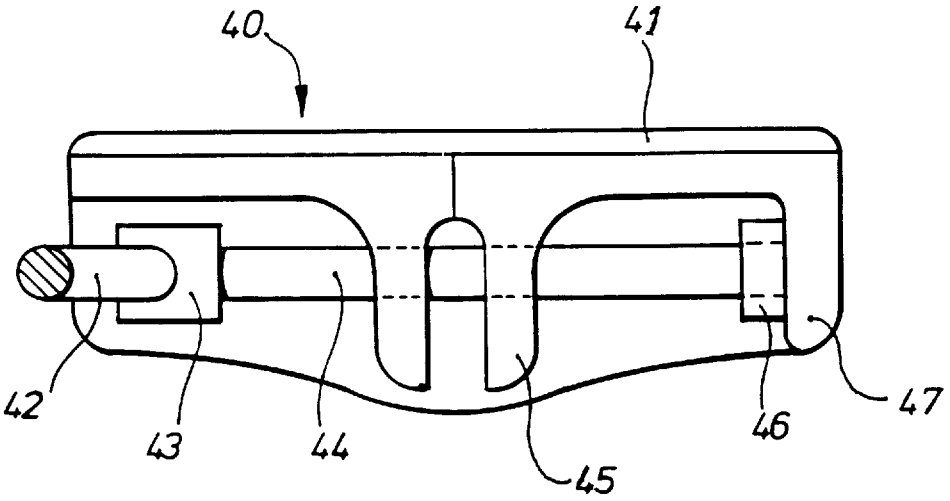
FIG. 3 is a plan view of a head for a flat-faced putter with improved balance properties, according to another embodiment of the first aspect of the invention.
Figure 4:
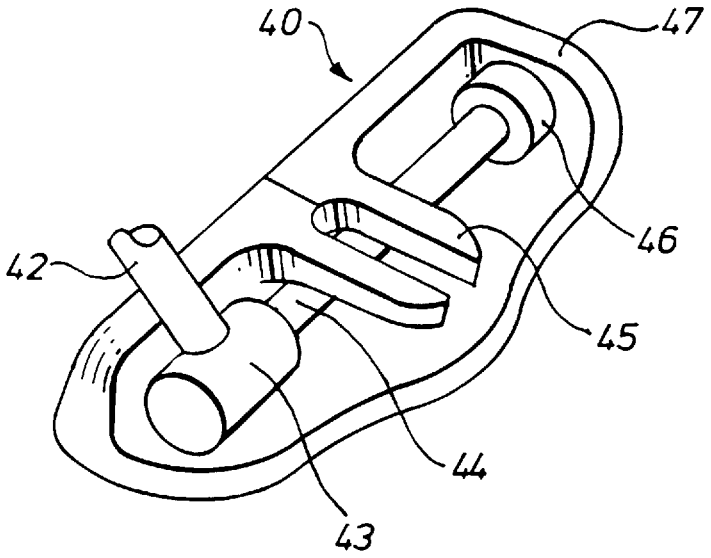
FIG. 4 is a perspective view of the head of FIG. 3.

With reference to FIGS. 3 and 4, a flat-faced putter head is shown generally at 40; the face is indicated at 41. The lower end 42 of the putter shaft is attached to a connection block 43 to which is also attached the heel end of a connection bar 44 which engages beneath lugs 45 formed integrally with the putter head body. The toe end of the bar 44 is inserted in a hole formed in a locator element 46 carried by the end wall 47 of the head.

For a cylindrical putter head such as illustrated in FIG. 2, the outside diameter should preferably be between 67% and 80% of the diameter of a golf ball so that contact with the ball will normally be below the horizontal diametral plane, to enhance the tendency to top- or forward-spin. The length of the head should preferably be from 2.8 to 3.7 times the diameter or approximately 2.3 to 2.6 times the diameter of a golf ball.

Figure 5:
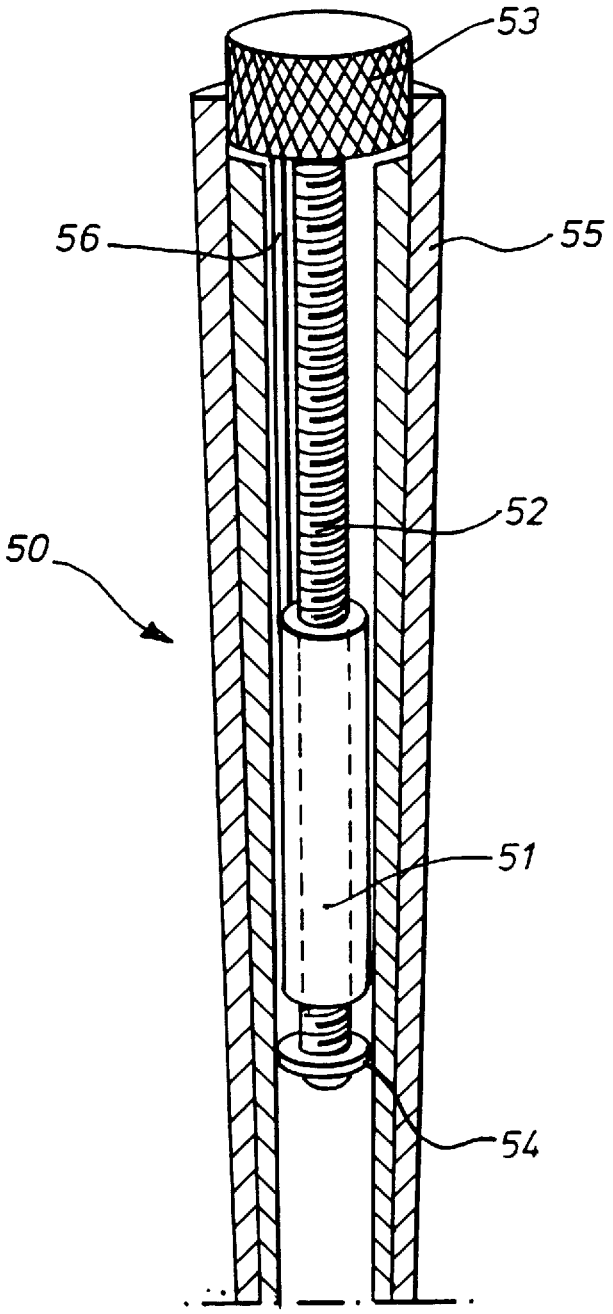
FIG. 5 is a part-sectional perspective view of the upper part of a putter shaft containing a counterbalance weight assembly, in accordance with the second aspect of the present invention.

With reference to FIG. 5, a putter shaft 50 is provided internally with a counterbalance weight 51. The weight 51 is able to travel along a threaded rod 52 in the manner of a threaded worm-drive; a knurled knob 53 is attached to the upper end of the rod and extends from the top of the putter shaft. The counterbalance weight assembly is located in the grip portion of the putter shaft 50; the grip is shown as a sleeve 55. The weight 51 is prevented from leaving the threaded rod 52 by virtue of a restriction in the form of an annulus 54 in the inner wall of the shaft 50, the inner wall also being provided with a groove 56 in which a peg (not shown) extending from the weight 51 is slidably engaged to prevent the weight from turning with the rod 52. The grip portion 55 of the putter shaft 50 extends about and is fast with the knurled knob 53 so that rotation of either the grip 55 or the knob 53 about the shaft 50 rotates the rod 52 and thus causes the counterbalance weight 51 to travel along the threaded rod 52.

It is to be understood that the invention enables a golf club to be assembled from pre-formed modular parts according to the requirements of the individual user. The parts may be made from different materials and have different dimensions (and thus weights) provided that they are pre-machined so that their mating surfaces will fit together. As to the choice of materials, the strike response will be harder for a heavy material such as stainless steel and softer for a relatively lighter material such as brass; the "feel" of the club depends on the weight distribution. The invention therefore also provides a kit of parts for assembly of a golf club as hereinbefore described, the parts being modular and including a selection of heads, shafts and connection bars, whereby a selected connection bar is connectible between a selected head at the toe end region thereof and a selected shaft to provide shock-absorption properties at the interconnection zone. Preferably the kit also includes a selection of locator elements, torsion blocks and additional weights for adding to the toe and/or heel ends of the head as desired.

What is claimed is:

1. A golf club comprising a head and a shaft, in which the head comprises a strike face and has a distal end comprising a locator element having a predetermined weight and a proximal end and a lower end of the shaft is connected to a connection bar which extends longitudinally of the head behind the strike face, one end of the connection bar being attached to said locator element at the distal end thereof and the other end thereof being attached to the shaft via a torsion link comprising a body whose weight counterbalances the weight of the head distal end, said body being spaced apart from and not connected with said head of said club.

2. A golf club according to claim 1, in which the lower end region of the shaft is loosely or resiliently connected to the upper part of the head.

3. A golf club according to claim 1, in which said shaft is attached to said connection bar via a cranked link which displaces the axis of the shaft away from the proximal mounting of the connection bar.

4. A golf club according to claim 3, in which the cranked link comprises a goose-neck connector which may be rotationally adjustable in the connection bar and which may have a further bend, out of the plane which accommodates the goose-neck, to provide for the lie angle of the putter to be adjusted.

5. A golf club according to claim 1, including means for provision of removable weights at either end of said head.

6. A golf club comprising a hollow cylindrical head and a shaft, the head having a distal end and a proximal end and being provided with end closures at the respective distal end and proximal end, said distal end further comprising a disc formed with an axial hole and a lower end of said shaft connected to a connection bar which extends axially within said head, the connection bar having a distal end and a proximal end, said distal end of said connection bar being fitted within said axial hole of said disc, said proximal end of said connection bar being fitted in an axial hole of a counterbalance body attached to the lower end of said shaft to provide shock-absorption properties as between said shaft and said connection bar, at least one of said head end closures being provided with means for adjusting the weight thereof to adapt the balance and strike response characteristics of the club to different golf course greens and slopes.

7. A golf club as claimed in claim 6 wherein said weight adjusting means adjusts the amount of weight of said head.

8. A golf club as claimed in claim 6 wherein the weight of said disk can be adjusted by adding weights thereto.

9. A kit of parts for assembly of a golf club comprising:

a shaft;

a head having a strike face and a toe or distal end;

a connector bar mountable to said head and having a proximal end and a distal end;

a locator element having a predetermined weight and flexurally attachable to said connector bar at said connector bar distal end, said locator element being mountable to said head; and means for mounting said connector bar at the proximal end thereof to said shaft via a torsion link comprising a body whose weight is a counterbalance to the weight of at the connector bar distal end, said body being attachable to said shaft so as to not be connected with said club head.

* * * * *